US006890394B2

(12) United States Patent
Carsley et al.

(10) Patent No.: US 6,890,394 B2
(45) Date of Patent: May 10, 2005

(54) HEATING OF METAL ALLOY SHEET BY THERMAL CONDUCTION

(75) Inventors: John E. Carsley, Clinton Township, MI (US); Richard Harry Hammar, Utica, MI (US); John Robert Bradley, Clarkston, MI (US)

(73) Assignee: General Motors Corporation, Detroit, MI (US)

( * ) Notice: Subject to any disclaimer, the term of this patent is extended or adjusted under 35 U.S.C. 154(b) by 224 days.

(21) Appl. No.: 10/323,298

(22) Filed: Dec. 18, 2002

(65) Prior Publication Data

US 2004/0118488 A1 Jun. 24, 2004

(51) Int. Cl.[7] ..... C22F 1/047; C22K 3/00
(52) U.S. Cl. ..... 148/564; 72/709
(58) Field of Search ..... 148/564; 72/709

(56) References Cited

U.S. PATENT DOCUMENTS 4,079,232 A * 3/1978 Brokoff et al. ..... 219/154
4,474,044 A * 10/1984 Leistner et al. ..... 72/19.1
5,410,132 A * 4/1995 Gregg et al. ..... 219/604
6,211,497 B1 4/2001 Matsen et al. ..... 219/645
6,253,588 B1 7/2001 Rashid et al.
6,547,895 B2 4/2003 Bradley et al. ..... 148/535

* cited by examiner

*Primary Examiner*—George Wyszomierski
(74) *Attorney, Agent, or Firm*—Kathryn A. Marra

(57) ABSTRACT

A method is disclosed for heating a cold worked sheet of superplastically formable metal composition to recrystallize its microstructure to a formable condition and/or to heat the sheet to a temperature for an immediate forming operation. The sheet is placed between two electrical resistance heated platens maintained at a suitable temperature for recrystallizing and/or heating the metal sheet through its side surfaces. In a preferred embodiment a critical gap is maintained between the platens and the sheet to permit rapid conductive heating of the expanding sheet without marring its surfaces.

12 Claims, 2 Drawing Sheets

HEATING OF METAL ALLOY SHEET BY THERMAL CONDUCTION

TECHNICAL FIELD

This invention pertains to the heating of a cold worked metal alloy sheet to recrystallize its microstructure to a highly formable (e.g., superplastic) condition, and/or to raise its temperature for an immediate forming operation. More specifically, this invention pertains to a method using closely spaced heated platens to rapidly heat the cold worked sheet by conduction under controlled conditions for such recrystallization and/or heating and forming.

BACKGROUND OF THE INVENTION

Body panels for automotive vehicles are currently being manufactured using a superplastic forming process applied to certain magnesium-containing aluminum alloy sheet stock. At the present time, the sheet stock is a specially prepared fine grain microstructure, aluminum alloy 5083. AA5083 has a nominal composition, by weight, of about 4 to 5 percent magnesium, 0.3 to 1 percent manganese, a maximum of 0.25 percent chromium, about 0.1 percent copper, up to about 0.3 percent iron, up to about 0.2 percent silicon, and the balance substantially all aluminum. Generally, the alloy is cast into a slab of a suitable thickness and subjected to a homogenizing heat treatment. The slab is then gradually reduced in thickness by a series of hot rolling operations to a strip in the range of twenty to forty millimeters depending somewhat on the goal for the final thickness of the sheet. The strip is then cold rolled, usually in stages with possible interposed anneals, to a final sheet thickness in the range of about one to three or four millimeters. The result of the thermomechanical processing is a coil of smooth surface, aluminum sheet stock, the microstructure of which has been severely strained.

If this aluminum sheet stock is ultimately to be formed into automotive vehicle external body panels, or the like, the smooth surface of the cold rolled sheet is very important. The cold rolled surface must be free of visual defects and that surface quality must be retained in subsequent heating, forming and finishing steps so that the visible surface of the final part is commercially acceptable. In automotive manufacturing such a surface is called a "Class A surface."

The cold rolled strip is not suitable for a high elongation forming operation. It must be reheated to recrystallize the elongated, strained grains that characterize its microstructure by the nucleation and growth of nearly strain-free grains. The goal of the recrystallizing heat treatment in the case of AA5083 sheet is to produce a very fine grained microstructure characterized by a principal phase of a solid solution of magnesium in aluminum, with well distributed, finely disbursed particles of intermetallic compounds containing minor alloying constituents such as, $Al_6Mn$. The recrystallized grain size in the microstructure is uniformly about ten to fifteen micrometers. Because the dispersed phase is so small the material is sometimes described as "pseudo single phase." The fine-grained sheet can be heated and superplastically formed into a complex part like an automotive body panel. The sheet can sustain substantial elongation at a suitable strain rate and at a temperature in the range of about 440° C. (825° F.) to about 550° C. (1020° F.).

U.S. Pat. No. 6,253,588 entitled "Quick Plastic Forming of Aluminum Alloy Sheet Metal," by Rashid et al. and assigned to the assignee of this invention, discloses practices by which the aluminum alloy sheet metal is stretch formed at a suitable forming temperature into automotive body panels and the like. The '588 patent describes practices for forming aluminum alloy sheet metal using a pressurized working fluid such as air. In accordance with this practice, the sheet metal blank is first placed on a pre-bending and heating tool. The heated tool heats the sheet metal blank to its forming temperature and pre-bends it, if desired, for placement on a second tool configured for stretch-forming the heated sheet into a body panel or the like. The heated blank is then clamped at its edges and gas pressure is applied which forces the sheet into the tool cavity to assume the requisite shape of the part. The preparation of the sheet material before forming is critical so that it can sustain the deformation necessary to form the part and retain a commercially acceptable surface finish.

If the sheet metal blank selected for forming has been recrystallized by the coil manufacturer (i.e., supplied in the soft, fully annealed O temper condition), the heating on the pre-heat tool may further the grain growth of its microstructure. Alternatively, if a blank is taken from a cold rolled coil supplied without heat treatment, e.g., in the H18 temper, the metal is not formable because it has experienced a cold rolling reduction of 74% or more as a last processing step. When an un-recrystallized blank is placed on the preheat and pre-bend tool of the Rashid, et al, '588 patent disclosure, the sheet material is recrystallized as it is slowly heated to the panel forming temperature over a period of five to ten minutes. Once the sheet has been recrystallized and reaches a forming temperature, for example, in the range of 825° F. to 845° F. (about 441° C. to 452° C.), it is bent and transferred to a heated forming press in which it is stretch formed into a vehicle body panel or the like.

The prolonged preheating of the sheet metal blank to effect recrystallization of the cold-worked sheet to produce a superplastic formable microstructure has taken five to ten minutes but produced a very formable sheet. Slow recrystallization of the sheet metal on a forming tool has been used in the commercial production of body panels. However, the heating times on the open tools have not been consistent and the heating time has become rate limiting for the overall forming process described in the '588 patent. It is now desired to start with blanks from a cold worked coil and more rapidly heat them to enable a faster rate of production. It is intended that the more rapid heating rate will also produce an even finer recrystallized grain size and greater superplastic ductility.

Accordingly, it is an object of this invention to provide a method of consistently conduction heating a cold-worked, potentially superplastic formable, aluminum alloy sheet so as to quickly convert its highly strained microstructure into a recrystallized fine grained microstructure that is suitable for a superplastic forming operation. At the same time that the sheet is being recrystallized it is being heated to a suitable forming temperature, such as a stretch forming temperature. When the application of the part requires Class A surface quality, that quality is maintained. It is also an object of the invention to provide such a heating method applicable to other cold worked sheet metal alloys that can be recrystallized under static conditions to a highly deformable pseudo single phase material.

SUMMARY OF THE INVENTION

It has been found that it is possible and practical to rapidly recrystallize a sheet blank of cold worked, H18 temper designation, AA 5083 material, sized for vehicle body panel manufacture, and heat it to a suitable superplastic forming temperature. In accordance with a preferred embodiment of the invention, one or two cold worked aluminum alloy sheets are placed between two massive, electrically heated platens. The temperature of the platens is controlled at a pre-determined level at or just above the desired final temperature of the sheet. The platens are suitably heated with inserted electrical resistance heating rods, which can be controlled to provide a uniform temperature over the entire heating surface of the massive plates.

One important application of the invention is to produce a recrystallized and formed sheet metal part with a Class A surface. In this embodiment of the invention, the hot platens are closed to a closely spaced position in which the cold worked sheet is not in full surface-to-surface contact with either platen. In the case of heating an AA5083 sheet blank that is 1.6 mm thick, for example, between upper and lower steel platens, the gap between the platens is suitably about 2.1 mm. The nominal difference of 0.5 mm between the gap spacing and the thickness of the unheated sheet results in rapid heating of the sheet while protecting its surfaces. Reducing this difference promotes faster heating but increases the possibility of scratching of the sheet surface.

Shims located on the lower platen at the periphery of the sheet serve to retain the desired spacing. This close platen spacing permits three dimensional expansion of the sheet as it is rapidly heated, but the platens do not grip the sheet(s) and scratch or mar its surfaces. The sheet is supported by the lower platen but the expansion of the sheet causes it to move out of full surface contact with the lower platen. There is a thin layer of air between the opposing platens and the intervening sheet. But the air film is quiescent and heat transfer from the platens through the air is largely by conduction.

It is found that the sheet is suitably recrystallized to a microstructure for superplastic forming and heated to a suitable temperature for such forming within a period of, for example, thirty seconds or less. It was unexpected that the sheet could be suitably heat treated for superplastic forming in such a short time. Advantageously, this period is comparable to the actual panel forming operation so that the heating operation no longer slows the panel manufacturing process. The platens are opened and the hot sheet is removed and, without intentional cooling, placed on a forming tool for pre-bending and/or final part formation.

Attention to the dimensional difference between the spacing of the hot platens and the thickness of the sheet is important when it is desired to retain a mar-free quality on a surface of the sheet facing a platen. However, if the nature of the part to be formed does not require a Class A finish, or if two sheets are heated and their facing surfaces can be used for the high quality surface, then maintenance of a sheet-to platen gap is not critical and the platens can be closed against the sheet surfaces.

This invention is likewise applicable to the static recrystallization of other pseudo single phase alloys such as aluminum alloys of the 2xxx series, other alloys of the 5xxx series, alloys of the 7xxx series and, for example, suitable magnesium, ferrous and titanium alloys.

Other objects and advantages of the invention will became apparent from a detailed description of a preferred embodiment which follows.

DESCRIPTION OF THE PREFERRED EMBODIMENT

Superplastic metals can undergo large uniform strains prior to failure. The ability of a metal to deform superplastically depends primarily on its composition, grain size, strain rate, and deformation temperature. Metals that behave superplastically usually have a grain size less than about 10 micrometers and they are deformed within the strain rate range of $10^{-5}$ to $10^{-1}$ per second at temperatures greater than about half of their absolute melting temperature (0.5 T). The fine grain size is believed to allow grain boundary sliding and grain rotation to contribute to the large superplastic strains. Therefore, in order to deform superplastically, an aluminum alloy or other superplastic alloy of, for example, titanium, iron or magnesium must first be capable of being processed into a fine grain structure that remains stable during deformation.

This invention is applicable to superplastic metal sheet alloys that are statically recrystallized to a fine grain structure prior to a forming operation. The practice of the invention will be illustrated in connection with magnesium containing, aluminum sheet alloys, specifically AA 5083. Production of the alloy sheet includes a combination of hot rolling, cold rolling and finally a heat treatment to develop small recrystallized grains of aluminum-magnesium solid solution with dispersed insoluble materials.

In the case of AA5083, aluminum sheet alloy, it is suitably received from a supplier in the heavily cold-worked, (e.g., H18 temper designation) condition. As stated above, in actual manufacturing operations the sheet material has been recrystallized at a relatively slow heating rate as it is preheated usually on an open hot pre-bending tool. The heating practice often takes 10 minutes or more and a suitably recrystallized sheet material is formed. It has now been discovered that the recrystallizing can be accomplished at a much faster rate provided suitable heating techniques are provided.

An exemplary goal for this small gap conduction heating process may be to heat the cold worked sheet to a temperature of, 900° F. (482° C.) in less than 45 seconds. This heating program is to transform the microstructure from severely strained, cold worked grains to a recrystallized fine grain, pseudo single phase, soft (e.g., O Temper), condition. And the sheet is to be heated to a temperature at which it can be stretched and/or drawn into a body panel or the like product of complex shape and with a high quality surface finish on its visible side.

A metal alloy blank for an automotive vehicle body panel may, for example, have dimensions of 1625 mm (64 inches)×1117 mm (44 inches)×1.6 mm (0.063 inch). It is often coated on one or both sides with a film of boron nitride lubricant particles to assist in a high temperature panel forming operation against a suitable forming tool. In order to heat such a blank, or pair of blanks, in accordance with this invention it is necessary to use larger heated plates or platens.

Figure 1:
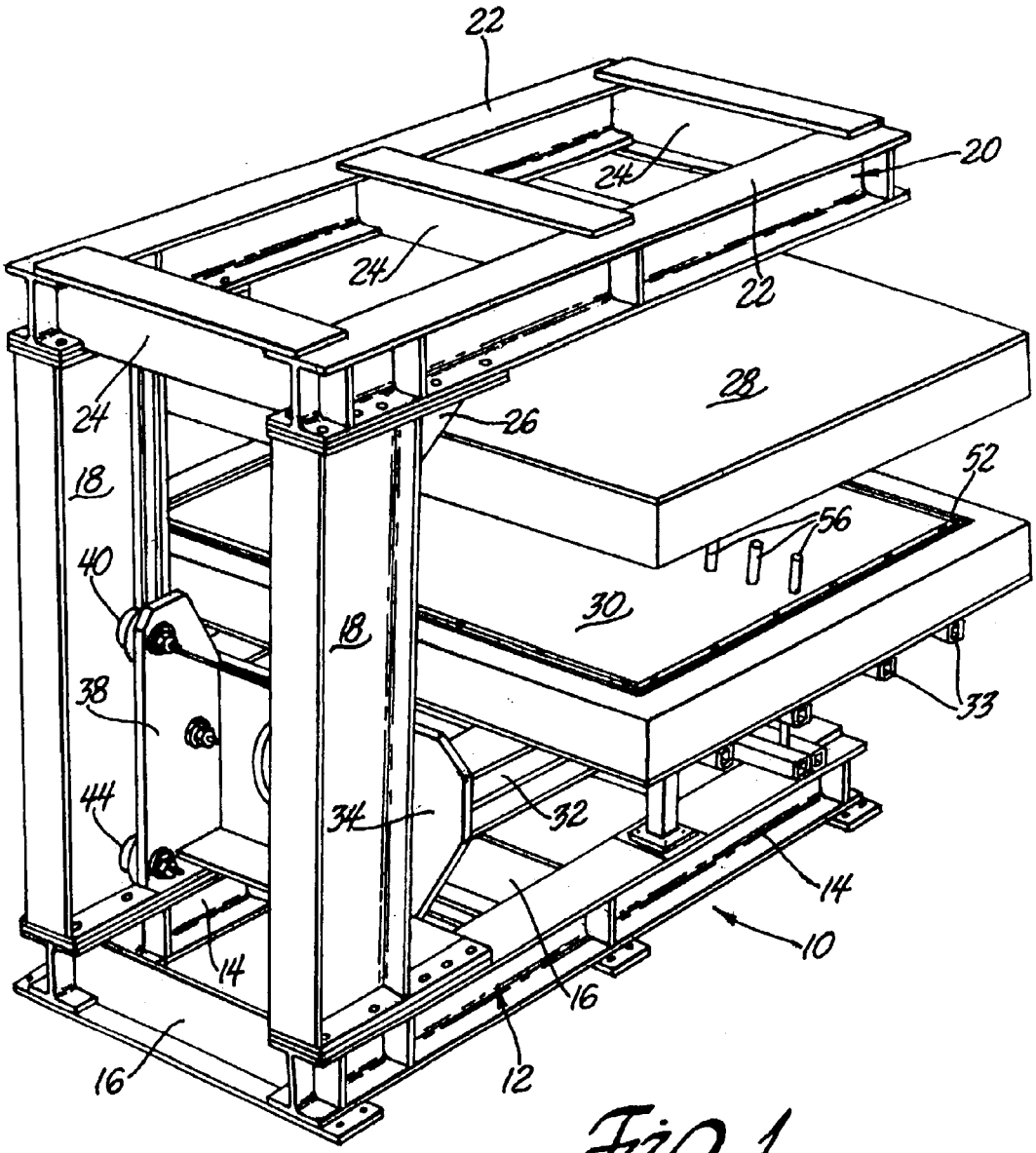
FIG. 1 is an oblique elevation view of a fixed upper heating platen and a movable lower platen, each supported on a framework. The lower platen is shown in its lower, open position for removing a heated recrystallized sheet and loading a new cold worked metal sheet.

FIG. 1 illustrates a machine 10 for supporting horizontally disposed heated platens for the practice of an embodiment of this invention. Machine 10 comprises base frame member 12 suitably formed of longitudinal steel beam frame members 14 with lateral support beams 16. Fixed at one end of base frame member 12 are two vertical I-beams 18. I-beams 18 serve as support columns for machine 10. Attached to the upper end of beams 18 and cantilevered over the base frame member 12 is an upper frame member 20. The horizontal upper frame member 20 is also formed of two longitudinal steel beam frame members 22 welded or bolted to lateral support beam members 24. Cantilevered upper frame member 20 is further supported in its horizontal position by corner supports 26 welded to the upper ends of vertical beams 18.

Attached to upper frame member 20 by suitable hangers, not shown, is a horizontally disposed upper heating platen 28. Preferably, upper platen 28 is attached in a fixed position to upper frame 20.

Figure 2:
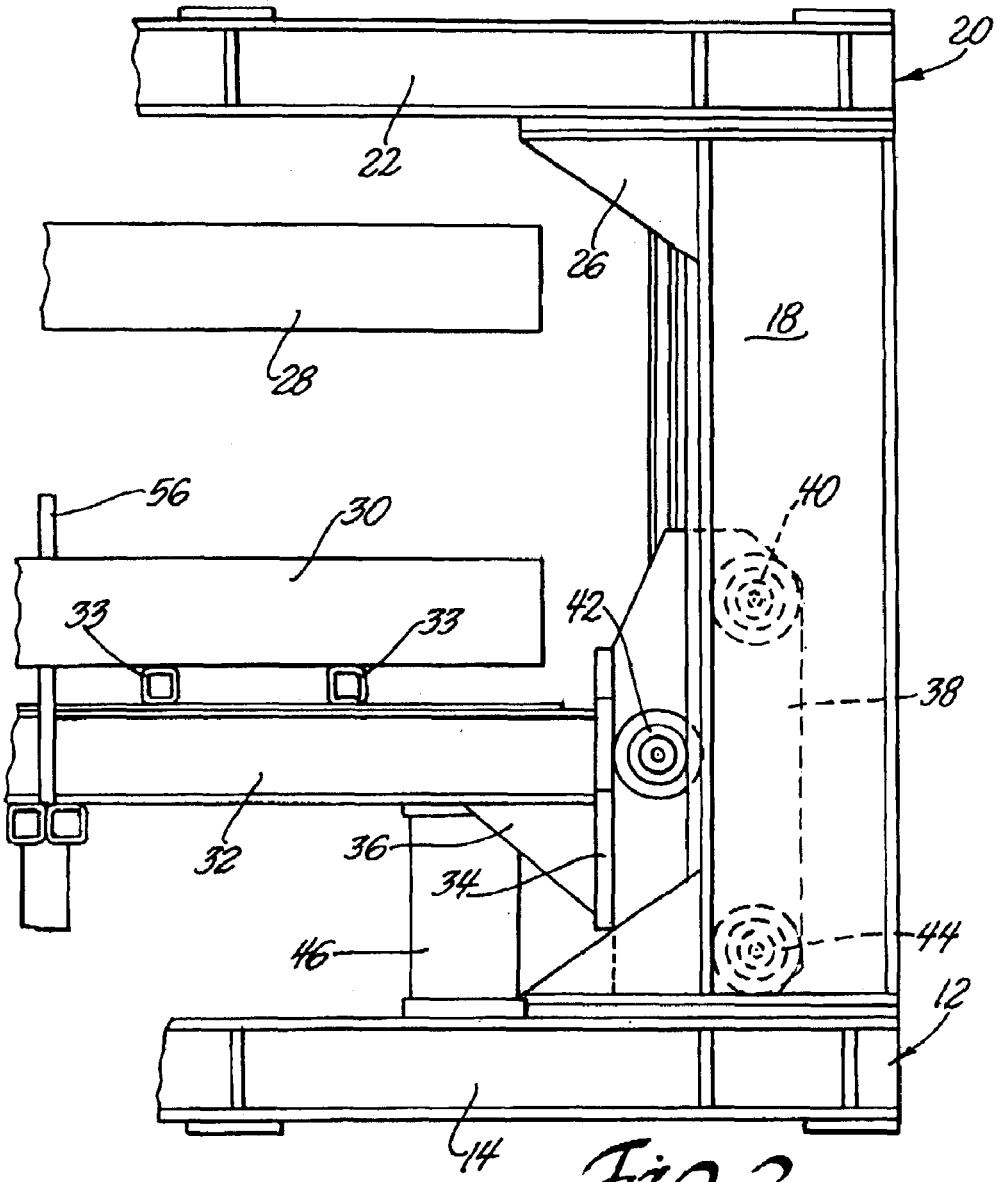
FIG. 2 is a side view of a portion of the framework and upper and lower platens showing one of the air cylinders and a roller-rail system for raising and lowering the movable heating platen.
Figure 3:
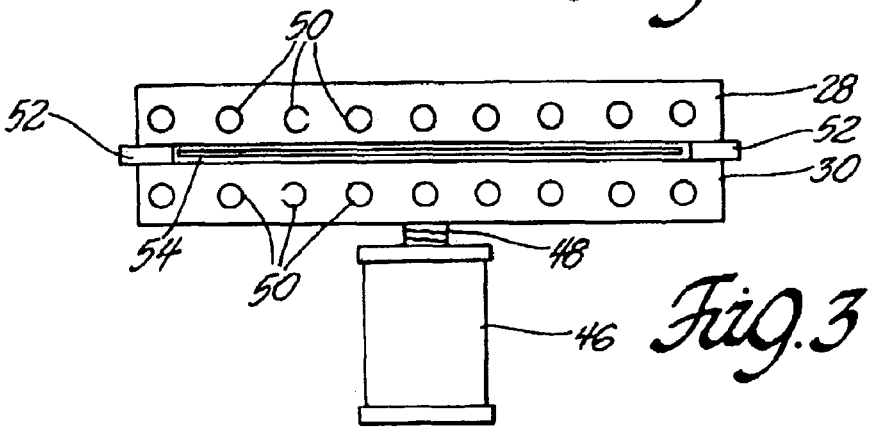
FIG. 3 is an isolated side schematic view of the platens in their closed position for small gap conduction heating of a cold worked metal sheet. The relative size of the sheet and gap are not to scale.

A lower heating platen 30 is carried on lower frame member 12 and vertical beams 18 so that platen 30 can be moved from an open position as seen in FIGS. 1 and 2 to a closed position very near to the upper platen 28 as seen in FIG. 3. When lower heating platen 30 is in its open position a heated blank ready for immediate forming is mechanically removed from the hot platen 30 and a new cold worked blank is loaded onto it. The lower platen 30 is raised to its closed position for heating the sheet metal blank 54.

Lower heating platen 30 is carried on a pair of horizontal beams 32 (one seen in FIGS. 1 and 2). Several lateral tubes 33 are welded crossways between beams 32 to carry platen 30. Beams 32 are fixed at their ends to vertical end plate 34 and further supported by corner plate 36. Vertical end plate 34 spans between vertical beams 18. Attached to vertical end plate 34 at locations close to vertical beams 18 are two vertical side plates 38. Each vertical side plate 38 carries three rollers 40, 42, and 44 located to movably secure vertical side plates 38 to the adjacent head portions of 1-beams 18. The upper and lower rollers 40 and 44 are placed in opposition to central roller 42. Thus, the support structure for lower heating platen 30 permits it to be raised and lowered along the head webs of vertical I-beams 18. Two high pressure air cylinders 46 (one seen in the broken off side view of FIG. 2) with piston rods 48 (one seen in FIG. 3) are actuatable to raise and lower heating platen 30 to carry out the heating process of this invention.

FIG. 3 shows a side view of upper heating platen 28 and lower platen 30 in their closed position. It is preferred that the heating platens be supported in a horizontal attitude to facilitate supporting and loading of the metal alloy sheets. In order to reduce heat loss, it is preferred that the platens only be opened enough to accommodate handling of the sheets. Typically, for the sheet sizes of this example, the lower platen 30 need only be lowered five or six inches from its closed position against the fixed upper platen 28. Shaft 48 is actuated by cylinder 46 to raise (close) and drop (open), lower platen 30. The main length of shaft 48 is broken out in FIG. 3 to accommodate location of this illustration on the drawing page.

Plates 28 and 30 are suitably made of steel for heating AA5083 cold worked blanks. Inserted across the width of each heating platen are several parallel electrical resistance heating rods 50. Heating rods 50 are connected to a suitable electrical power source and temperature controller, not shown. If, for example, the desired final temperature of the AA 5083 sheet is 900° F. (482° C.) the electrical power delivered to heating rods 50, collectively or individually, will be controlled so that each platen, 28 and 30, is maintained uniformly at a temperature in the range of about 900 to 910° F. (482 to 488° C.). The high temperature platen heaters rapidly heat each cold worked sheet in succession toward its specified temperature without overheating.

As illustrated in FIGS. 1 and 3, the spacing between the very flat surfaces of the platens 28 and 30 is maintained by the thickness of shims 52. Preferably, shims 52 are attached to the movable lower platen 30 to facilitate placement of the cold worked blank sheet on that platen. For heating a sheet of 1.6 mm thickness, shims of about 2.0 to 2.2 mm thickness may be employed, especially when the surface quality of the cold rolled sheet is to be preserved. Such a spacing allows the sheet 54 to freely expand as it is heated from ambient temperature to about 900° F. (482° C.). If two sheets are heated together the thickness of the shims will be suitably increased. The intent is to provide sufficient space between the platens so that the expanding sheet is not grasped or impeded by the platens in a way that mars the surface of the sheets. However, the space between the hot platen surfaces and the sheet 54 will be small. It is exaggerated in FIG. 3. There will be air space between the sheet and the platens at some locations, but the heat transfer will be largely by conduction and very rapid. The time required to heat the 1.6 mm blank of cold worked AA5083 will be about 30 seconds. The time for a specific application is soon determined by trial, but typically less than 45 seconds depending on the thickness of the sheet(s) and the dimension of the gap between them and the platens.

In FIG. 3 shims 52 are shown at the edges of platen 30 while in FIG. 1 the shims are inside the edges of that representation of the platen. It may be desired to place insulation around the steel heating platen to reduce heat loss. The insulation is not shown in FIG. 3 for simplicity of illustration. However, the representation of platens 28 and 30 in FIGS. 1 and 2 contemplates that the edges and back surfaces of these heating plates may be embedded in a suitable insulating material.

After the heating time has elapsed the lower platen is 30 lowered by action of air cylinders 46. The center portion, or other portion, of the heated sheet 54 can be raised by actuation of a series of ejector pins 56 located in the lower platen 30. The sheet is then removed mechanically from the platen 30. The hot sheet can then be placed on a forming tool to utilize its softened and formable condition. Since the heated sheet is at its forming temperature it is transferred without undue delay to the forming tool. If some delay and cooling is anticipated it may be desired to heat the sheet to a slightly higher temperature to compensate for such cooling before forming.

Thus, a controlled heating by conduction from heated platens is used to rapidly transform (recrystallize) a cold worked sheet of suitable metal alloy to a highly formable microstructure and heat it to a suitable forming temperature to utilize the newly acquired formability. In the case of a cold worked AA5083 sheet up to two millimeters or so in thickness, the heating period is typically less than 45 seconds and often less than 30 seconds. The formability of the AA 5083 sheet typically exceeds $300^{+}$% elongation by standard tensile test.

In a preferred embodiment of the invention that has been described, a gap is maintained between the sheet(s) to be heated and the hot platens to preserve a surface quality on the sheet(s). However, in a heating and forming application in which the sheet surfaces are not an issue the platens may closely engage the sheet for more rapid heating. Similarly, the heating platens in the above example were positioned for receiving and heating sheets in a horizontal position. The platens can be supported for opening and closing in any attitude. However, it is recognized that the arrangement of the heating platens can be set to accommodate sheet positioning required by other processing stations of a manufacturing line. Also the platens have been illustrated as having flat heating surfaces. But the sheet may have been bent or otherwise formed prior to heating and the platens can be shaped to receive and heat such sheets.

As stated, an object of the invention is to accomplish the rapid heating by thermal conduction of a cold worked sheet of superplastic metal alloy composition to recrystallize the microstructure of the sheet and to heat it to a temperature suitable for superplastic forming. However, a user of such sheet material may choose to have the cold rolling supplier perform the recrystallization step and supply the sheet in a superplastic formable condition. Obviously, the user of such sheet stock can still benefit from the use of this invention to rapidly heat the cold rolled and recrystallized material to a suitable superplastic forming temperature.

Thus, while the practice of the invention has been illustrated in terms of a specific embodiment, it is recognized that other embodiments could readily be devised by one skilled in the art. The scope of the invention is not intended to be limited by the disclosure of specific illustrative examples.

What is claimed is:

1. A method of forming a sheet of a superplastic formable, metal alloy composition comprising providing at least one cold worked sheet of said composition;

controlling the temperature of a pair of opposing heated platens at a predetermined level to recrystallize the cold worked microstructure of said metal sheet to a fine grained microstructure for superplastic forming; said platens being movable between an open position for receiving said sheet and a closed position for conductive heating of said sheet with one side surface of said sheet facing one platen and the opposite side surface of said sheet facing the opposing platen;

heating said sheet between said platens by said conductive heat transfer to said side surfaces to recrystallize the cold worked microstructure of said metal sheet to a fine grained microstructure for superplastic forming;

removing said sheet from between said platens; and forming the heated sheet.

2. A method as recited in claim 1 in which two said sheets are heated simultaneously between said platens.

3. A method as recited in claim 1 in which two said sheets are heated simultaneously between said platens, each of said sheets having a side surface with a desired surface quality that is to be maintained during said heating and said sheets being heated between said platens with said surface quality side surfaces facing each other, protected from contact with said platens.

4. A method as recited in claim 1 in which said sheet is of a superplastic formable aluminum alloy composition.

5. A method as recited in claim 4 in which said sheet has experienced a cold work reduction to a H18 temper state.

6. A method as recited in claim 1 in which said sheet is of a superplastic formable, magnesium containing aluminum alloy composition.

7. A method as recited in claim 6 in which said sheet has experienced a cold worked reduction to a H18 temper state.

8. A method of forming a sheet of a superplastic formable, composition as recited in claim 1 comprising said platens being movable between an open position for receiving said sheet and a closed position for heating said sheet; said platens defining, in said closed position, a gap with the side surfaces of said sheet, said gap being sized and shaped: (i) to permit thermal expansion of said sheet in said gap, (ii) to heat said sheet by conductive heat transfer through said gap from each platen through the facing side surfaces of said sheet, and (iii) said gap to be no greater than three millimeters plus the thickness of said sheet;

heating said cold worked sheet between said platens by said conductive heat transfer to said side surfaces to recrystallize the cold worked microstructure of said sheet to a fine grained microstructure suitable for superplastic forming;

removing said sheet from between said platens; and forming the heated sheet.

9. A method of forming a sheet of a superplastic formable, aluminum alloy composition comprising providing a cold worked sheet of said composition, said sheet having a side surface of desired surface quality that is to be maintained in an article produced by said forming;

heating said cold worked sheet by conductive heat transfer between two heated platens to a predetermined sheet temperature to recrystallize the cold worked microstructure of said sheet to a fine grained microstructure suitable for superplastic stretch forming, and to heat said sheet to a superplastic forming temperature; said platens defining, in said closed position, a gap with the side surfaces of said sheet, said gap being sized and shaped: (i) to permit thermal expansion of said sheet in said gap without marring said surface of desired quality, (ii) to heat said sheet by conductive heat transfer through said gap from each platen through the facing side surfaces of said sheet, and (iii) said gap to be no greater than three millimeters plus the thickness of said sheet; and then forming the heated sheet.

10. A method as recited in claim 9 in which said sheet is a magnesium containing, aluminum alloy sheet.

11. A method as recited in claim 10 in which said sheet has a thickness up to about two millimeters and is recrystallized and heated to said forming temperature within 45 seconds.

12. A method as recited in claim 9 in which said sheet has a thickness up to about two millimeters and is recrystallized and heated to said forming temperature within 45 seconds.

* * * * *